US006447193B1

(12) United States Patent
Kageyama et al.

(10) Patent No.: US 6,447,193 B1
(45) Date of Patent: Sep. 10, 2002

(54) WRITING UTENSILS

(75) Inventors: Hidehei Kageyama, Kawagoe (JP); Osamu Takahashi, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/722,424

(22) Filed: Nov. 28, 2000

Related U.S. Application Data

(62) Division of application No. 09/347,455, filed on Jul. 6, 1999, now Pat. No. 6,309,129.

(51) Int. Cl.[7] ..... B43K 5/16
(52) U.S. Cl. ..... 401/104; 401/52; 401/92
(58) Field of Search ..... 401/104, 92, 88, 401/89, 93, 94, 90, 52

(56) References Cited

U.S. PATENT DOCUMENTS

| | | | | |
|---|---|---|---|---|
| 3,037,483 A | | 6/1962 | Caviglione | 401/104 |
| 3,637,316 A | | 1/1972 | Bross | 401/104 |
| 4,376,590 A | * | 3/1983 | Kuo | 401/90 |
| 4,551,035 A | | 11/1985 | Baker et al. | 401/104 |
| 5,165,813 A | * | 11/1992 | Kageyama et al. | 401/94 |
| 5,221,152 A | * | 6/1993 | Chuang | 401/90 |
| 5,354,141 A | * | 10/1994 | Watanabe et al. | 401/94 |
| 5,413,428 A | | 5/1995 | Kageyama | 401/104 |

FOREIGN PATENT DOCUMENTS

| | | | |
|---|---|---|---|
| GB | 738695 | 10/1955 | 401/104 |

* cited by examiner

*Primary Examiner*—David J. Walczak
(74) *Attorney, Agent, or Firm*—McGinn & Gibb, PLLC

(57) ABSTRACT

A writing utensil includes an external cylinder, a lead feeding mechanism housed in the external cylinder and propelling a lead forward, and a rear-end knocking member movable in conjunction with the lead feeding mechanism in an axial direction. The rear-end knocking member is integrally formed and includes a cylindrical section, a clip section, and a connecting section. The cylindrical section has a central hole into which the rear end of a lead case of the lead feeding mechanism is inserted and in which the rear of the cylindrical section protrudes from the rear end of the external cylinder. A clip section extends outside and along the external cylinder in an axial direction and a connecting section passing through a stem hole formed in the rear side face of the external cylinder for connecting the cylindrical section and the clip section together.

7 Claims, 4 Drawing Sheets

WRITING UTENSILS

The present Application is a Divisional Application of U.S. patent application Ser. No. 09/347,455, filed on Jul. 6, 1999, now U.S. Pat. No. 6,309,129.

BACKGROUND OF THE INVENTION

1. Field of the Invention

The present invention relates to a writing utensil, and in particular to a writing utensil that can be inexpensively manufactured.

2. Description of thee Related Art

A conventional writing utensil, (e.g., a typical mechanical pencil) includes a lead feeding mechanism housed in an external cylinder, a case for holding leads of the lead feeding mechanism extending rearwardly away from the writing tip through the external cylinder, and an eraser receiving section inserted in the rearward portion of the lead holding case which includes an eraser inserted into the receiver.

In addition, a clip is configured as a separate element and is attached to the outside of the external cylinder by pressure, or alternatively, by sandwiching the clip between the external cylinder and a loop-shaped attachment formed at one end of the clip and screwing the loop-shaped attachment to the external cylinder.

A conventional ball point pen includes a refill, a spring, and a refill feeding mechanism, all of which are housed in an external cylinder, and a cap inserted at the rear end of a cam bar constituting the refill feeding mechanism. A clip is attached to the external cylinder in the same manner as for the mechanical pencil.

Such conventional writing utensils have as separate parts, the clip, a part for depressing on the rear end of the writing utensil, and a part for attaching the clip, thereby increasing the number of necessary parts. Furthermore, a large amount of time and labor is required to attach the clip, thereby increasing manufacturing costs.

SUMMARY OF THE INVENTION

In view of the foregoing and other problems, disadvantages, and drawbacks of the conventional writing utensils, the present invention has been devised, and it is an object of the invention to provide a writing utensil that can be inexpensively manufactured and easily assembled.

To attain the above and other objects, the invention provides a writing utensil having an external cylinder, a feeding mechanism housed in the external cylinder for propelling a writing medium forward, and a rear-end knocking member that can move in conjunction with the feeding mechanism in the axial direction.

The rear-end knocking member is integrally formed with a cylindrical section having a central opening into which the rear end of the feeding mechanism is inserted and the rear of the cylindrical section protrudes from the rear end of the external cylinder. A clip section extends outside and along the external cylinder in the axial direction, and a connecting section passing through a stem hole formed in the rear side face of the external cylinder connects the cylindrical section and the clip section together.

Furthermore, the writing utensil may be a mechanical pencil, and a lead case, which is part of the feeding mechanism, can be inserted into a central hole in the cylindrical section. Preferably, a restricting section is formed inside the cylindrical section of the rear end knocking member. If such a restricting section is formed, the front surface forms a receiving surface for receiving the rear end of the lead case and the rear surface forms a tapered surface for facilitating the insertion of a lead.

In addition, the rear end of the cylindrical section preferably forms an eraser receiving section into which an eraser is inserted.

The writing utensil may be a ball point pen, a felt-tip pen, or a magic marker, and a cam bar of the feeding mechanism can be inserted into the central hole in the cylindrical section.

Since the rear-end knocking member is integrally formed and includes the cylindrical section, the clip section, and the connecting section, the inventive writing utensil requires only a small number of parts and can be simply assembled. Assembly is accomplished by inserting the connecting section through the external cylinder into the stem hole formed in the rear side face of the external cylinder and inserting the rear end of the feeding mechanism into the central hole in the cylindrical section.

Moreover, if the writing utensil is a mechanical pencil, the lead case of the feeding mechanism may be inserted into the central hole in the cylindrical section.

In an embodiment where the restricting section is formed inside the cylindrical section and its front surface forms a receiving surface for receiving the rear end of the lead case, the lead case is reliably moved forward when the rear-end knocking member is depressed. Additionally, writing leads can be easily and reliably refilled by being inserted from the rear of the rear-end knocking member via the cylindrical section. The leads will not be broken when refilling if a tapered surface has been formed at the rear surface of the restricting section.

Further, the rear of the cylindrical section acts as the eraser receiving section, thereby further decreasing the number of required parts. In addition, if the writing utensil is a ball point pen, a felt-tip pen, or a marking pen, the cam bar of the feeding mechanism may be inserted into the central hole in the cylindrical section.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
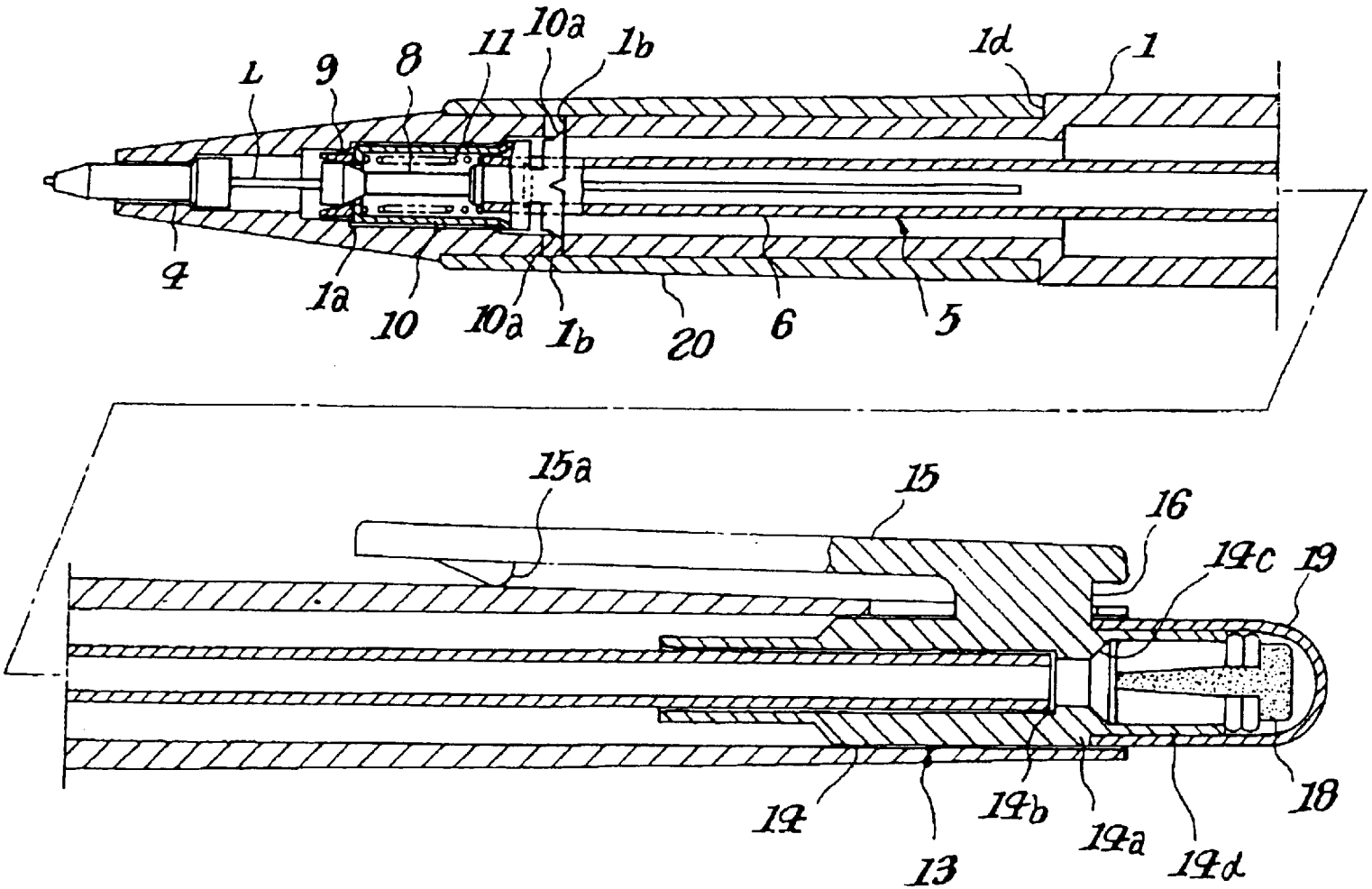
FIG. 1 is a vertical sectional view of a mechanical pencil according to a first embodiment of the invention.

Referring now to the drawings, and more particularly to FIGS. 1-5, there are shown preferred embodiments of the method and structures according to the present invention.

First Embodiment

Referring to the FIGS. 1–3, a first embodiment of the present invention will be described below.

Figure 2:
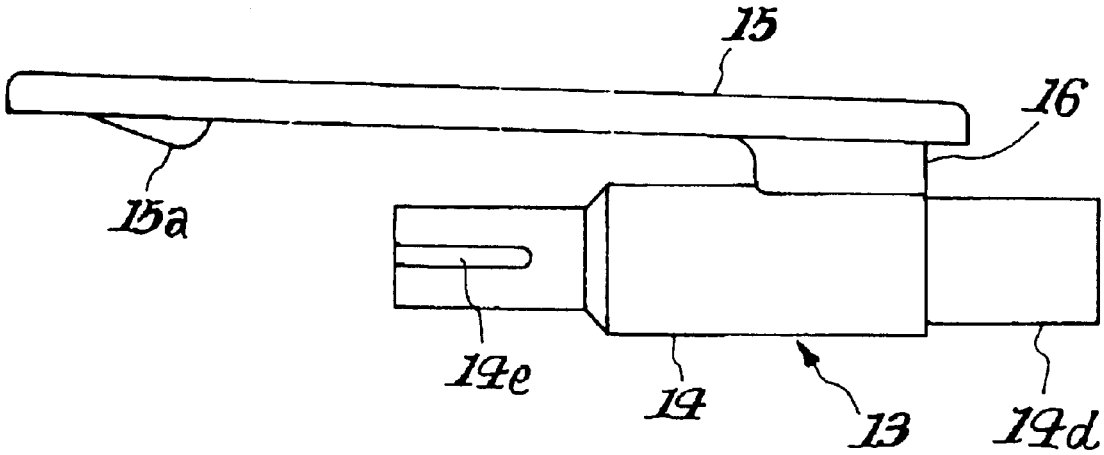
FIG. 2A is a side view of a rear-end knocking member of the pencil in FIG. 1.
FIG. 2B is a front view of the rear-end knocking member in FIG. 1.
Figure 2:
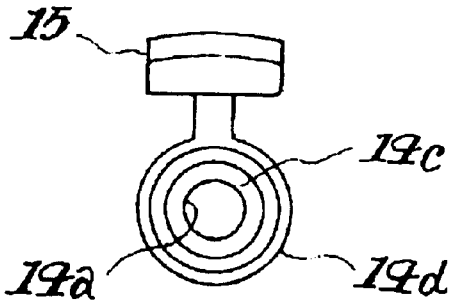

FIG. 1 shows a vertical sectional view of a mechanical pencil according to a first embodiment of this invention. In FIG. 1, an external cylinder 1 is shown which includes at its tip a foreslider 4 that can project from and withdraw into the cylinder 1 and also a lead feeding mechanism 5 housed therein.

The lead feeding mechanism 5 has a well-known configuration includes a lead case 6, a chuck 8 fixed to the front of the lead case 6, a chuck ring 9 installed outside the chuck 8, a chuck ring receiving sleeve 10 abutting the rear end of the chuck ring 9, and a chuck spring 11 interposed between the chuck ring receiving sleeve 10 and the lead case 6.

The front end of the chuck ring receiving sleeve 10 (e.g., towards the tip) abuts a front stage section 1 a of the external cylinder 1, and two protruding sections 10*a*, each protruding in the radial direction and having a triangular cross-section; are provided at the rear end of the chuck ring receiving sleeve 10 at an interval corresponding to 180°.

The protruding sections 10*a* are fitted in slots 1*b*, provided correspondingly to the external cylinder 1, to restrict the movement of the chuck ring receiving sleeve 10 within the external cylinder 1 in the axial direction.

A rubber gripper 20, for improving the user's grip, is fitted in an outer groove 1*d* formed in the front of the external cylinder 1. The gripper 20 also covers slots 1*b*.

Although not illustrated, a guide groove, the width of which gradually decreases from the rear of external cylinder 1 to slots 1*b*, is preferably formed in the inner surface of the external cylinder 1, to facilitate the fitting of protruding sections 10*a* of the chuck ring receiving sleeve 10 into slots 1*b*.

A rear-end knocking member 13 is located in the rear of the external cylinder 1. The rear-end knocking member 13 is an integral part (e.g., integrally formed) including a cylindrical section 14, a clip section 15, and a connecting section 16 for connecting the cylindrical section 14 and the clip section 15 together, as shown in FIG. 2A.

The rear end of the lead case 6 is inserted into a central hole in the cylindrical section 14. A slit 14*e* is formed at the front end of the cylindrical section 14 to facilitate insertion. A restricting section 14*a* is formed inside the cylindrical section 14 so that its front surface forms a receiving surface 14*b* that can abut the rear end of the inserted lead case 6. In addition, the rear surface of the restricting section 14*a* of the cylindrical section 14 forms a tapered surface 14*c* to act as a funnel for smoothly guiding leads to the lead case 6.

The rear of the cylindrical section 14 forms an eraser receiving section 14*d* protruding from the rear end of the external cylinder 1. An eraser 18, preferably with a metal jacket, is detachably inserted into a central hole in the eraser receiving section 14*d*. The central hole is in communication with a central hole in the front of the cylindrical section 14 through the restricting section 14*a*. Optionally, a cap 19 is installed over the eraser receiving section 14*d*.

The clip section 15 extends outside and along the external cylinder 1 in the axial direction. A connecting section 16 passes through a stem hole 1*c* formed in the rear side face of the external cylinder 1 to integrally connect the clip section 15 outside the external cylinder 1 and the cylindrical section 14 inside the external cylinder 1. A protruding section 15*a* is formed at the tip of the clip section 15. Although not illustrated, a vertical groove extending in the axial direction may be formed at a position of the outer side face of the external cylinder 1 corresponding to the protruding portion 15*a*. In this manner the protruding section 15*a* is fitted in this vertical groove and is guided and moved in the axial direction.

Figure 3:
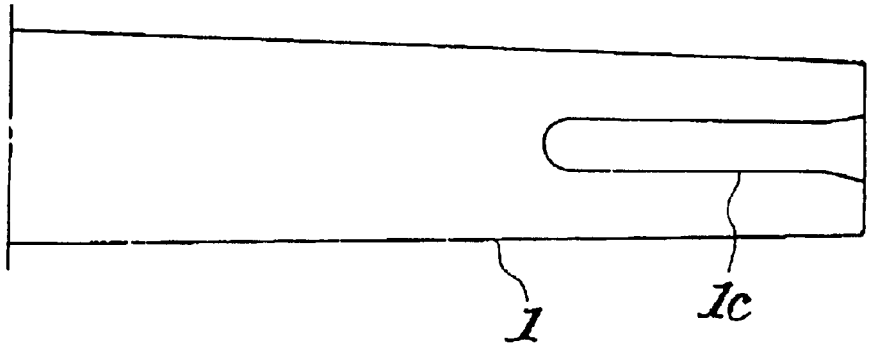
FIG. 3 is an enlarged top view of the rear end of an external cylinder 1 of the pencil in FIG. 1.

FIG. 3 shows an enlarged view of the stem hole 1*c* in the external cylinder 1. The stem hole 1*c* extends to the rear end of the external cylinder 1, and its rear end is tapered such that its width increases rearwardly.

The mechanical pencil of the first embodiment of the invention is assembled in the following manner.

First, the foreslider 4 is inserted into the external cylinder 1 from its rear, and then the lead feeding mechanism 5 is inserted into the external cylinder 1 from its rear. The protruding sections 10*a* of the chuck ring receiving sleeve 10 are fitted in slots 1*b*.

Then, the rear-end knocking member 13 is inserted into the external cylinder 1 from its rear. That is, the connecting section 16 is inserted into the stem hole 1*c* from its rear end so that the lead case 6 of the lead feeding mechanism 5 is pressed into the front of the cylindrical section 14.

In this case, due to the relatively long rear end portion of the stem hole 1*c*, the connecting section 16 can be reliably inserted into the stem hole 1*c* even if it cannot be directly seen due to its position under the clip section 15.

Thus, the lead feeding mechanism 5 can move through the external cylinder 1 in the axial direction in conjunction with the rear-end knocking member 13.

In addition, due to its integration with the lead feeding mechanism 5, the rear-end knocking member 13 is prevented from slipping out from the rear of the external cylinder 1.

Finally, the eraser 18 is inserted into the eraser receiving section 14*d*, the cap 19 is installed over the eraser receiving section 14*d*, and the gripper 20 is pressed into the outer groove 1*d*. Thus, the assembly is finished.

Whenever the rear-end knocking member 13 of the mechanical pencil is depressed (e.g., "knocked") from the rear, the lead feeding mechanism 5 inserted into the cylindrical section 14 of the rear-end knocking member 13 moves forward to move the chuck 8 forward against the force of the chuck spring 11. Then, the chuck 8 can open to feed a lead L from the chuck 8 by a predetermined length per actuation, thereby feeding the lead L from the foreslider 4, as in the well-known lead feeding mechanism.

The rear-end knocking member 13 may be depressed by pressing on the clip section 15 or, of course, by pressing the eraser receiving section 14*d* together with the cap 19. After depressing, the chuck spring 11 causes the rear-end knocking member 13 to return to its rear position together with the lead case 6.

The lead L can be housed by pressing on the eraser receiving section 14*d* of the rear-end knocking member 13 together with the cap 19 or by pressing on the clip section 15 for moving the lead case 6 forward to maintain the chuck 8 open and pressing the tip of the lead into the external cylinder 1 so as to withdraw the lead L into the external cylinder 1.

To refill the writing utensil with leads, the cap 19 and the eraser 18 are removed from the eraser receiving section 14*d*, and leads are inserted into a central hole in the eraser receiving section 14*d* from its rear. The tapered surface 14*c* formed between the eraser receiving section 14*d* and the restricting section 14*a* guides the leads so as to pass through the restricting section 14*a* smoothly.

As described above, the first embodiment enables the rear-end knocking member 13 to be configured as an integral part including the cylindrical section 14, the clip section 15, and the connecting section 16, thereby reducing the number of parts required for the writing utensil to enable inexpensive manufacturing and simple assembly.

Second Embodiment

Figure 4:
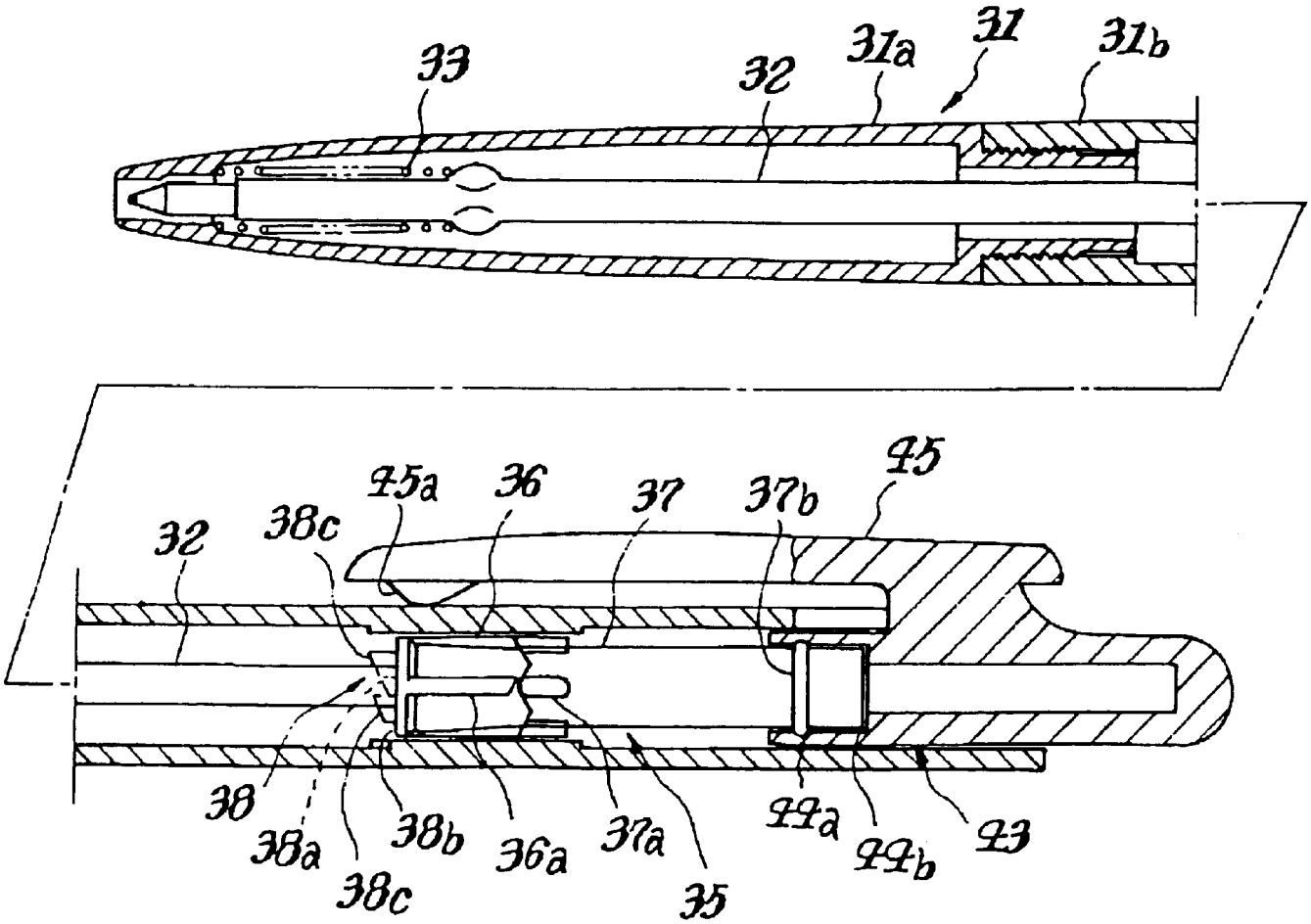
FIG. 4 is a vertical sectional view of a ball point pen according to another embodiment of the invention, showing part of the internal structure in a front view.
Figure 5:
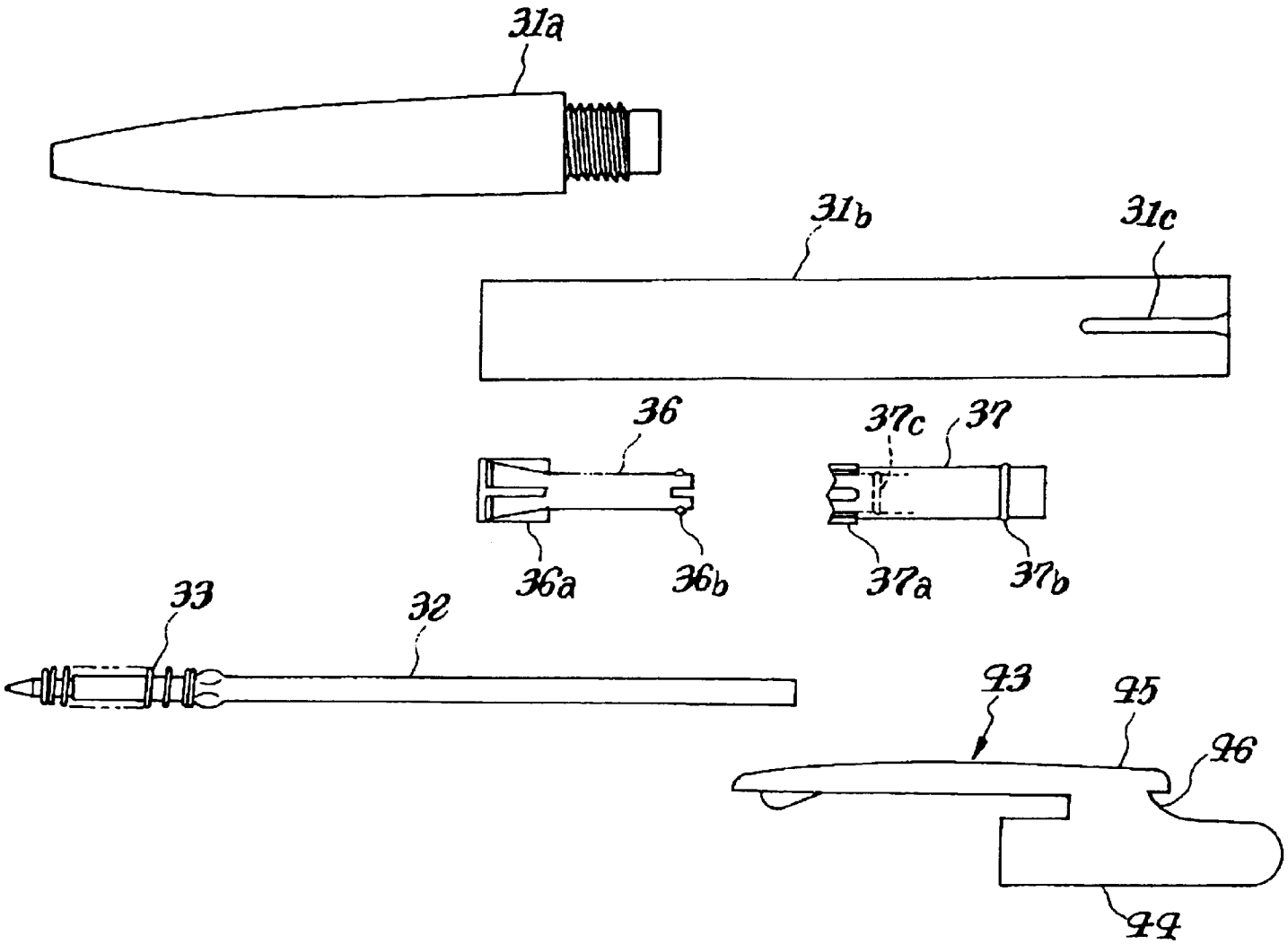
FIG. 5 is an exploded view of the pen of FIG. 4.

Referring to FIGS. 4 and 5, a second embodiment of the invention will be described below.

As shown in FIG. 4, an exemplary writing utensil is a ball point pen in a vertical sectional view according to this embodiment, and FIG. 5 is an exploded view of FIG. 4.

As shown in FIGS. 4 and 5, an external cylinder 31 includes a forebarrel 31 a and an afterbarrel 31*b* that are coupled together by screwing the rear end of the forebarrel 31 a into the front end of the afterbarrel 31*b*.

The external cylinder 31 houses a refill 32 accommodating a writing medium (e.g., ink), a spring 33 that pushes the refill 32 rearwardly, and a well-known refill feeding mechanism 35 including a rotating cam 36 and a cam bar 37. A cam body 38 is formed on the inner surface of the afterbarrel 31*b* and has a plurality of (e.g., three) shallow grooves 38*a* and a plurality of (e.g., three) relatively deeper grooves 38*a* alternately formed in the circumferential direction, so that a projection 38*c* is located between each shallow groove 38*a* and each deep groove 38*a*.

The front ends of the shallow grooves 38*a* and projections 38*c* form a sawtooth-shaped cam surface. Protrusions 37*a* of the cam bar 37 are fitted in the grooves 38*a*, and protrusions 36*a* of the rotating cam 36 that protrude in the radial direction beyond the protrusions 37*a* of the cam bar 37 are selectively located in the deep grooves 38*a* or on the cam surfaces of the shallow grooves 38*a*.

The rotating cam 36 has an inside receiving surface that receives the rear end of the refill 32, and positions the refill 32 so that its tip protrudes out from the external cylinder 31 or withdraws into the cylinder 31 depending on the position of the rotating cam 36. Annular grooves 37*c* provided inside the cam bar 37 and protrusions 36*b* provided on the rear of the rotating cam 36 prevent the rotating cam 36 from slipping out from the cam bar 37.

The rear-end knocking member 43 is located in the rear of the afterbarrel 31*b*. The rear-end knocking member 43 is integrally formed and includes a cylindrical section 44, a clip section 45, and a connecting section 46 that connects the cylindrical section 44 and the clip section 45 together.

The rear end of the cam bar 37 is pressed into the central hole in the cylindrical section 44. To reliably couple the cylindrical section 44 and the cam bar 37 together, an annular protrusion 37*b* is formed in the rear of the cam bar 37, and a corresponding annular groove 44*a* is formed in the cylindrical section 44. A stage section is formed in the central hole in the cylindrical section 44, and forms a receiving surface 44*b* that can abut the rear end of the pressed-in cam bar 37.

The clip section 45 extends outside and along the external cylinder 31 in the axial direction, and the connecting section 46 passes through a stem hole 31*c* formed in the rear side face of the external cylinder 31 to integrally connect the clip section 45 outside the external cylinder 31 and the cylindrical section 44 inside the external cylinder 31.

A protruding section 45a is formed at the tip of the clip section 45. Although not illustrated, a vertical groove extending in the axial direction may be formed on the outer surface of the external cylinder 31 corresponding to the protruding section 45*a* so that the protruding section 45*a* is fitted in this vertical groove so as to be guided in the axial direction.

As shown in FIG. 5, in the rear part of the afterbarrel 31*b*, the stem hole 31*c* extends to the rear end of the afterbarrel, and the width of the rear end of the stem hole 31*c* increases rearwardly.

To assemble the ball point pen, first the refill 32 with the spring 33 installed thereon is inserted into the forebarrel 31*a* from its rear. Then, the cam bar 37 and the rotating cam 36, the rear of which is inserted into the central hole of the cam bar 37, are inserted into the afterbarrel 31*b* from its front end. The protrusions 37*a* , of the cam bar 37 and rotating cam 36 are inserted into the respective grooves 38*a*, 38*a* in the cam body 38.

Then, the forebarrel 31*a* and the afterbarrel 31*b* are coupled (e.g., screwed/threaded) together, and the rear-end knocking member 43 is inserted into the afterbarrel 31*b* from its rear. That is, the connecting section 46 is inserted into the stem hole 31*c* from its rear end, so that the cam bar 37 is pressed into the front of the cylindrical section 44.

Thus, the refill feeding mechanism 35 can move through the external cylinder 31 in the axial direction in conjunction with the rear-end knocking member 43. Additionally, due to its integration with the refill feeding mechanism 35, the rear-end knocking member 43 is prevented from slipping out from the rear of the external cylinder 31.

When the rear-end knocking member 43 is depressed at the rear of the ball point pen, the cam bar 37, pressing into the cylindrical section 44 of the rear-end knocking member 43, moves forward to press the rotating cam 36 and the refill 32 forward against the resistance of the spring 33. This rotates the rotating cam 36 through a predetermined angle to position the protrusions 36a of the rotating cam 36 on the cam surfaces of the shallow grooves 38*a*.

In this manner, the refill 32 is positioned so that its tip protrudes beyond the forebarrel 31*a*. The rear-end knocking member 43 may be depressed by pressing on the clip section 45 or on the cylindrical section 44.

When positioning a refill 32, the cylindrical section 44, or clip section 45, of the rear-end knocking member 43 is depressed to move the cam bar 37 forward, thereby pressing the rotating cam 36 and the refill 32 forward against the force of the spring 33. Then, the rotating cam 36 can be rotated through a predetermined angle to fit the protrusions 36a of the cam 36 into the deep grooves 38*a*, thereby retracting the refill 32 into the external cylinder 31.

To change the refill 32, the forebarrel 31 a and the afterbarrel 31*b* can be uncoupled (e.g., disassembled) by unscrewing before performing this operation.

As described above, in the ball point pen, rear-end knocking member 43 is integrally formed and includes the cylindrical section 44, the clip section 45, and the connecting section 46. This reduces the number of parts required for the writing utensil, thereby enabling inexpensive manufacturing and streamlined assembly.

In addition, by housing a fiber core or a felt instead of a ball housed at the tip of the refill, the second embodiment is also applicable to felt-tip pens or marking pens.

As described above, according to the present invention, the rear-end knocking member is integrally formed and includes the cylindrical section, the clip section, and the connecting section, so that the inventive writing utensil requires only a small number of parts and can be simply assembled.

Assembly is accomplished by inserting the connecting section into the external cylinder through the stem hole formed in the rear side face of the cylinder and inserting the rear end of the feeding mechanism into the central hole in the cylindrical section.

In addition, when the present invention is applied to a mechanical pencil, if the restricting section is formed inside the cylindrical section and its front surface forms a receiving surface for receiving the rear end of the lead case, the lead case can be reliably moved forward when the rear-end knocking member is pressed in a forward direction.

In addition, when replenishing leads, the leads can be easily and reliably inserted from the rear of the rear-end knocking member via the cylindrical section without being broken, if a tapered surface has been formed at the rear surface of the restricting section. By configuring the rear of the cylindrical section to also act as the. eraser receiving section, the number of required parts can be further decreased.

In addition, this invention is optimum for ball point pens, felt-tip pens, or marking pens, as well as mechanical pencils.

While the invention has been described in terms of several preferred embodiments, those skilled in the art will recognize that the invention can be practiced with modification within the spirit and scope of the appended claims.

Having thus described our invention, what we claim as new and desire to secure by Letters Patent is as follows:

1. A mechanical pencil, comprising:

an external cylinder having a stem hole formed in a rear side face thereof, said stem hole extending to a rear end of the external cylinder;

a feeding mechanism, housed in the external cylinder, for moving a lead forwardly, said feeding mechanism including a lead case; and a rear-end knocking member movable in conjunction with the feeding mechanism in the axial direction, wherein the rear-end knocking member is integrally formed and comprises:

a cylindrical section having a central hole into which a rear end of the lead case of the feeding mechanism is inserted, a rear end of the cylindrical section protruding from a rear end of the external cylinder;

a clip section extending along an outer periphery of the external cylinder in the axial direction; and a connecting section passing through the stem hole formed in the external cylinder to connect together the cylindrical section and the clip section.

2. The writing utensil according to claim 1, wherein said cylindrical section includes a restricting section formed therein so that a front surface of said cylindrical section forms a receiving surface for receiving a rear end of the lead case, and a rear surface of said cylindrical section forms a tapered surface for facilitating insertion of a lead.

3. The writing utensil according to claim 1, wherein the rear end of said cylindrical section forms an eraser receiving section into which an eraser is insertable.

4. The writing utensil according to claim 2, wherein the rear end of said cylindrical section forms an eraser receiving section into which an eraser is insertable.

5. A mechanical pencil, comprising:

a housing having a stem hole formed in a rear side face thereof, said stem hole extending to a rear end of the housing;

a writing medium feeding mechanism received in said housing for moving a writing medium forwardly, said writing medium feeding mechanism including a lead case; and a rear-end knocking member comprising an integrally formed cylindrical section having a central hole, a clip section, and a connecting section coupled between said cylindrical section and said clip section, wherein the lead case of said writing medium feeding mechanism is inserted into the central hole of the cylindrical section so that said rear-end knocking member moves forwardly in conjunction with said writing medium feeding mechanism.

6. The writing utensil according to claim 5, wherein said cylindrical section includes a restricting section formed therein so that a front surface of said cylindrical section forms- a receiving surface for receiving a rear end of the lead case, and a rear surface of said cylindrical section forms a tapered surface for facilitating insertion of a lead.

7. The writing utensil according to claim 5, wherein the rear end of said cylindrical section forms an eraser receiving section into which an eraser is insertable.

* * * * *